US005503324A

United States Patent [19]

Bacchetti et al.

[11] Patent Number: 5,503,324

[45] Date of Patent: Apr. 2, 1996

[54] SHIPPING AND DISPLAY BOX

[75] Inventors: Mark R. Bacchetti; Ronald E. Heiskell, both of Tracy; Ezra E. Pheys, San Mateo, all of Calif.

[73] Assignee: Advanced Container Corporation, Tracy, Calif.

[21] Appl. No.: 437,512

[22] Filed: May 9, 1995

Related U.S. Application Data

[63] Continuation of Ser. No. 192,108, Feb. 4, 1994, abandoned.

[51] Int. Cl.[6] ..... B65D 5/10; B65D 21/032

[52] U.S. Cl. ..... 229/112; 229/120; 229/122; 229/916; 229/939

[58] Field of Search ..... 229/112, 113, 229/119, 120, 122, 162, 915, 916, 939, 103.2

[56] References Cited

U.S. PATENT DOCUMENTS

| | | | |
|---|---|---|---|
| 1,978,626 | 10/1934 | Gault | 229/162 |
| 2,973,129 | 2/1961 | Stone et al. | 229/40 |
| 3,119,546 | 1/1964 | Wuerthner | 229/40 |
| 3,356,283 | 12/1967 | Champlin | 229/40 |
| 3,572,577 | 3/1971 | Dorfman | 229/916 |
| 3,660,116 | 5/1972 | Clark | 229/119 |
| 3,791,552 | 2/1974 | Hayes | 229/915 |
| 3,863,829 | 2/1975 | Merrill | 229/112 |
| 3,881,648 | 5/1975 | Hall | 229/112 |
| 4,353,495 | 10/1982 | Jes | 229/120 |
| 4,529,117 | 7/1985 | Brundage | 229/113 |
| 4,570,796 | 2/1986 | Groom | 229/40 |
| 5,163,609 | 11/1992 | Muise, Jr. | 229/113 |
| 5,263,612 | 11/1993 | Nederveld | 229/113 |

FOREIGN PATENT DOCUMENTS

| | | | |
|---|---|---|---|
| 1386251 | 12/1964 | France | 229/916 |
| 2240156 | 3/1975 | France | 229/120 |

OTHER PUBLICATIONS

Eight photographs of "Grandmom's Box" manufactured by Surpack S. A. of Peru (cited by Applicant on Mar. 6, 1995 but not previously considered).

*Primary Examiner*—Gary E. Elkins
*Attorney, Agent, or Firm*—Burns, Doane, Swecker & Mathis

[57] ABSTRACT

A shipping and display box is provided that has stacking holes in a bottom wall and stacking tabs protruding above a top wall for being received in stacking holes of a second shipping and display box stacked on top of the shipping and display box to prevent relative movement of the stacked boxes and to align the stacked boxes and facilitate drainage of water from the second shipping and display box into lower shipping and display boxes. Drain holes are formed proximate edges of the bottom wall of the shipping and display box, and diverter tabs are formed in side walls. The holes formed proximate the edges of the bottom wall facilitate drainage of water from an upper stacked box into holes formed by the diverter tabs in the side walls of lower stacked boxes. The shipping and display boxes are in the form of truncated pyramids to facilitate the cascading of water from upper boxes down through lower stacked boxes and to facilitate air ventilation by forming air passageways when the boxes are tightly stacked on a pallet. The shipping and display box is assembled using integrally formed flaps and slots. A blank for forming the shipping and display box and a method of assembling the blank into the shipping and display box are also described.

32 Claims, 7 Drawing Sheets

SHIPPING AND DISPLAY BOX

This application is a continuation of application Ser. No. 08/192,108, filed Feb. 4, 1994 now abandoned.

BACKGROUND OF THE INVENTION

1. Field of the Invention

The present invention relates to shipping and display boxes and, more particularly, to shipping and display boxes for fresh products such as asparagus.

2. State of the Art

The market for fresh products such as asparagus is widespread, and produce grown in areas such as California finds a market in distant areas such as the Eastern United States as well as in Europe. Produce such as fresh asparagus requires special handling techniques prior to and during shipment to maintain freshness. Typically, fresh asparagus is packed upright, with the bottom ends of the asparagus facing downward and the delicate tips facing upward to prevent damage. An absorbent pad is placed in the bottom of a packing container and is soaked with water for keeping the asparagus moist during transport.

Asparagus, will continue to grow in the packing containers unless it is kept below 60 degrees F. Accordingly, it is common to "hydro-cool" asparagus prior to shipping and to refrigerate the asparagus prior to and during shipping to maintain freshness and prevent growth. In hydro-cooling, the asparagus is soaked with cold water, usually between 34 and 40 degrees F., and the packed asparagus is then taken to a cold room, which is approximately 35 degrees F., before it is shipped in a refrigerated truck. The low temperatures prevent growth of the packed asparagus. Further, it is desirable to provide ample ventilation and water drainage of the asparagus in the packing containers to prevent rot and deterioration.

Such treatment of asparagus has required that the asparagus be shipped in packing containers that are waterproof. Because of the need to soak the packing containers with water in the hydro-cooler prior to and sometimes after transportation, prior corrugated paper or cardboard packing containers have generally not permitted containers on pallets more than one layer high, in part because water in the hydro-cooler is unable to reach the packing containers at the bottom of the pallet and containers within the center of the pallet stack. Further, even where it is possible to stack packing containers on top of one another, the packing containers tend to slide around relative to one another during transportation, usually because of the slick material, such as wax, used to waterproof the material forming the container. The sliding of the packing containers risks damage to the packed products. It is desirable to provide a waterproof packing container for shipping of fresh products that is able to provide for hydro-cooling of multiple stacks of packing containers, that offers sufficient ventilation and water drainage to the packed products to prevent the formation of rot and deterioration, that prevents relative movement of stacked packing containers during transportation, and that is able to withstand the force of multiple packed packing containers stacked on top of each other, and the impact forces due to transportation.

Most known packing containers for shipping fresh produce such as asparagus are formed by using staples and straps to hold the walls together. When the packing container reaches its destination, the merchant must generally destroy the packing container to remove the packed products. Further, the use of staples or straps to assemble the packing container is undesirable, at least because of the cost of fasteners, cost of labor to assemble with fasteners, and the cost to maintain the fastener equipment. Some packing containers, such as the shipping and display container shown in U.S. Pat. No. 3,863,829 to Merrill, offer the advantage of permitting a front and top wall of the packing container to be folded back to permit viewing and removal of the packed products. That packing container, however, relies on staples or other fastening means for assembly. Accordingly, it is desirable to provide a packing container that is adapted both for shipping and display of the packed product, and that does not require fasteners for its assembly.

Shipping and display boxes for fresh produce such as asparagus have, in the past, generally been manufactured from corrugated paper or cardboard. When the boxes are formed, they are passed through a shower of wax that provides some degree of water repellency. However, it is difficult to recycle the waxed corrugated paper or cardboard boxes. Further, the waxed corrugated paper or cardboard boxes tend to eventually absorb water and weaken. It is, accordingly, desirable to provide a readily recyclable shipping and display box that does not weaken appreciably when constantly soaked with water, such as during normal transport of hydro-cooled asparagus.

SUMMARY OF THE INVENTION

The present invention, generally speaking, provides a packing container or box for shipment and display of fresh products. The packing container is adapted to be stacked on top of or below other, like packing containers. The packing container permits hydro-cooling of multiple, stacked packing containers, has a minimal tendency to absorb water, and minimizes the relative movement of stacked packing containers during transportation. The packing container provides a pallet stack in which air ventilation is maximized throughout the pallet stack and the size of the pallet stack is minimized, thereby maximizing the number the number of packing containers that may be carried in transportation vehicles, such as trucks, cargo ships, and airplanes.

In accordance with one aspect of the present invention, a stackable shipping and display box includes a substantially rectangular top wall having front, rear, left, and right edges. Two or more registration tabs are provided, at least one registration tab extending upwardly from each of the left and right edges of the top wall. The box further includes a substantially rectangular bottom wall, having front, rear, left, and right edges. Trapezoidal left and right side walls are provided, the left and right side walls are provided with registration holes extending upwardly from bottom edges thereof for receiving registration tabs of a second box when the stackable box is stacked on top of the second box.

In accordance with another aspect of the present invention, a shipping and display box includes a top wall having left, right, front, and rear edges, a left side wall at the left edge of the top wall, and a right side wall at the right edge of the top wall. The box further includes a sloped side wall between the left and right side walls, the sloped side wall including a top panel hinged to one of the front and the rear edges of the top wall. The sloped side wall slopes substantially upwardly and inwardly. An opening is formed in the sloped side wall below at least a portion of the top panel. Means are provided for securing left and right edges of the top panel to the left and right side walls, respectively, such that a central portion of a bottom edge of the top panel bows outwardly relative to the one of the front and rear edges of the top wall. When the box is placed adjacent a second box such that the sloped side wall of the box faces a sloped side wall of the second box, water flowing off of outwardly bowed central portions of top panels of the box and the second box flows into openings in sloped side walls of the second box and the box, respectively.

In accordance with another aspect of the present invention, a stackable shipping and display box includes a bottom wall, a left side wall folded from the bottom wall to define a bottom left side edge, a top wall folded from the left side wall to define a top left side edge, and a right side wall folded from the top wall to define a top right side edge. The box further includes a front wall including a left side panel folded from the left side wall to define a front left side edge, and a right side panel folded from the right side wall to define a front right side edge. The box further includes a rear wall including a left side panel folded from the left side wall to define a rear left side edge, and a right side panel folded from the right side wall to define a rear right side edge.

In accordance with yet another aspect of the present invention, a blank for forming a shipping and display box includes a right side wall portion defined by left, right, front, and rear edges. The blank further includes a top wall portion defined by front, rear, left, and right edges, the left edge of the top wall portion being attached to the right edge of the right side wall portion, a left side wall portion defined by left, right, front, and rear edges, the right edge of the left side wall portion being attached to the left edge of the top wall portion, and a bottom wall portion defined by front, rear, left, and right edges, the left edge of the bottom wall portion being attached to the right edge of the left side wall portion. Front side wall portions are provided and include right, top, left, and bottom panels attached at front edges of the right side wall portion, the top wall portion, the left side wall portion, and the bottom wall portion, respectively. Rear side wall portions are provided and include right, top, left, and bottom panels attached at rear edges of the right side wall portion, the top wall portion, the left side wall portion, and the bottom wall portion, respectively. The blank is formed from corrugated material such that a longitudinal direction of flutes of the material extends from left to right.

BRIEF DESCRIPTION OF THE DRAWINGS

The present invention can be further understood with reference to the following description in conjunction with the appended drawings, wherein like elements are provided with the same reference numerals. In the drawings.

DETAILED DESCRIPTION OF THE PREFERRED EMBODIMENTS

Figure 1:
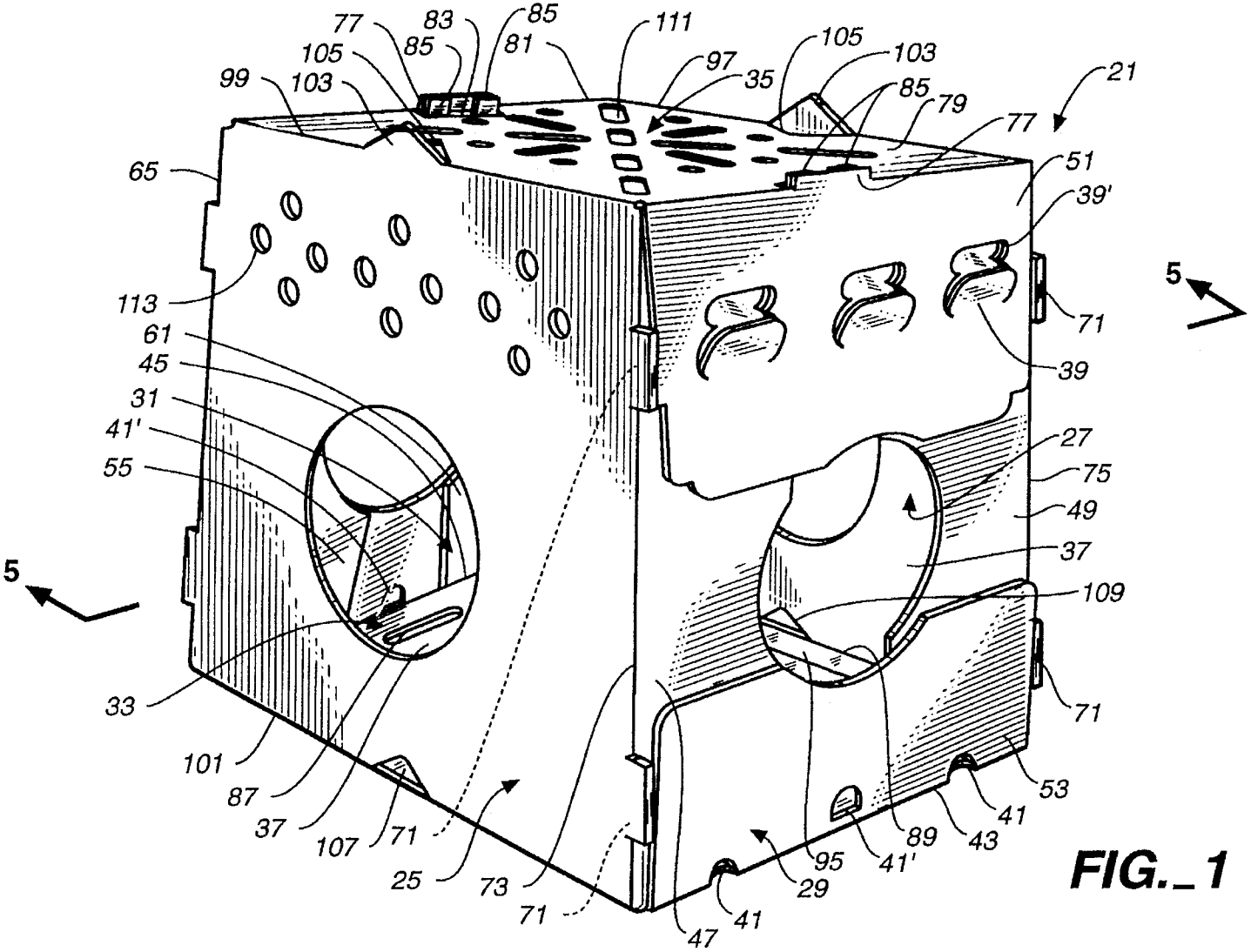
FIG. 1 is a perspective view of a shipping and display box according to an embodiment of the present invention.

A shipping and display box 21 according to an embodiment of the present invention is shown in perspective in FIG. 1. The shipping and display box 21 is preferably formed from a blank 23 such as that shown in FIG. 2 and described further below.

The shipping and display box 21 is preferably made out of a corrugated plastic material having "C-flutes" that are substantially vertical in the finished shipping and display box to provide great compressive strength to the box. The corrugated plastic material is preferably made out of 3 mm high density polypropylene, however, polyethylene may be used instead. The corrugated plastic material is preferably extruded, but may also be a laminated product. The box 21 can, however, be made out of any plastic material, corrugated for flat sheet, that would have similar strength characteristics to corrugated plastic.

Shipping and display boxes 21 according to a preferred embodiment of the invention normally contain approximately fifteen pounds of fresh asparagus and are arranged in stacks 21' of multiple, usually five, boxes. A shipping and display box 21 according to the present invention, manufactured with an extruded corrugated plastic material (3 mm thick polypropylene) was observed to withstand about 457 pounds force, with a deflection of 0.464 inches, which provides a substantial factor of safety under normal conditions, even when all of the shipping and display boxes in a stack are filled to overflowing with water during hydro-cooling. The ability of the shipping and display box 21 to withstand compressive forces is substantially unimpaired during hydro-cooling and transport of produce packed in the box because of the substantially water-impermeable nature of the preferred material for forming the box.

When the contents of the shipping and display box 21 are asparagus, it is desired to maintain a very low temperature of the asparagus to prevent growth of the asparagus, and to prevent rot and deterioration of the asparagus. Accordingly, materials for forming the shipping and display box will desirably not be adversely affected by low temperature. Corrugated plastic possesses this characteristic.

Figure 3:
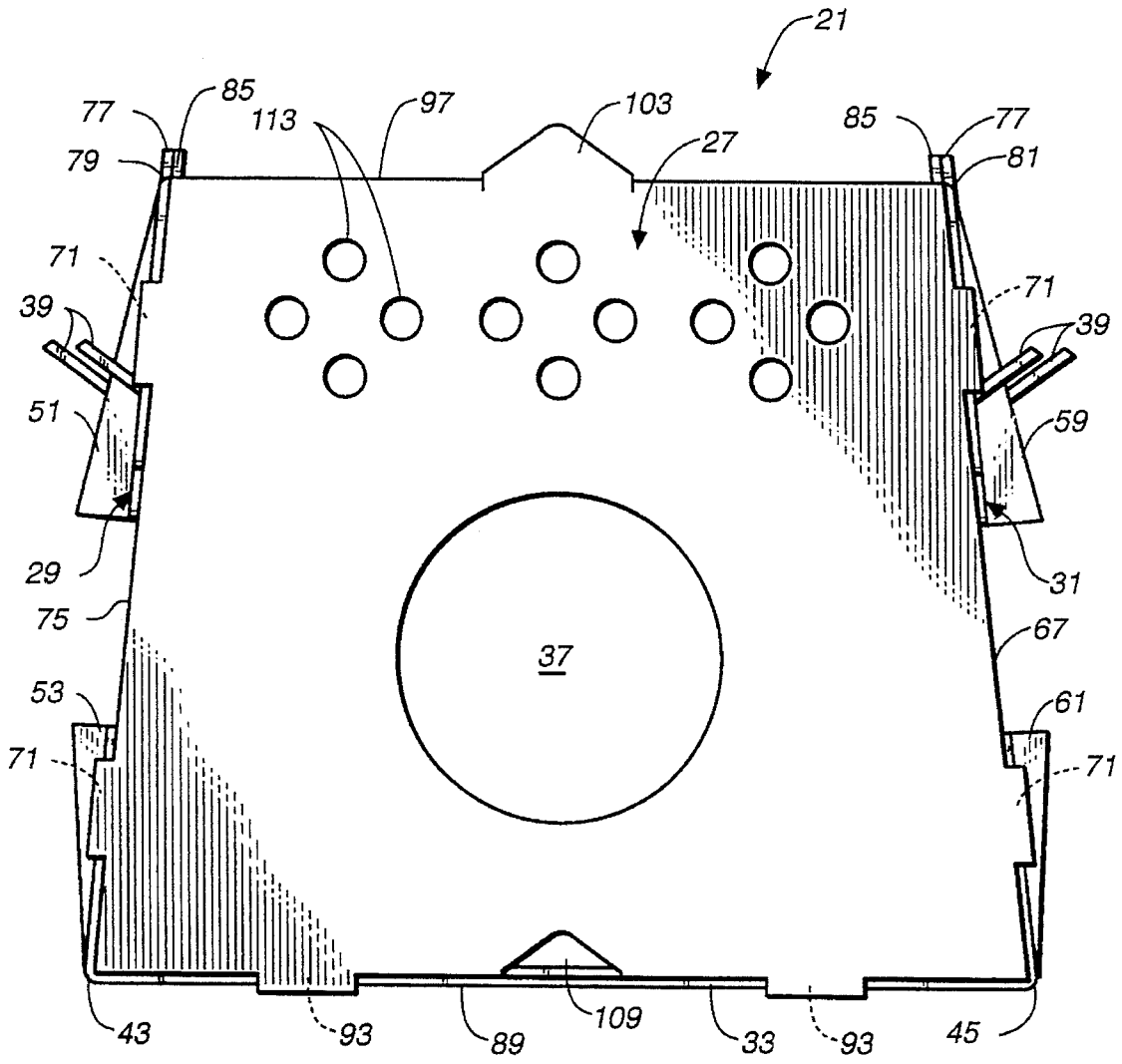
FIG. 3 is a view of a right side wall of a shipping and display box according to an embodiment of the present invention.

As seen in FIG. 1, the shipping and display box 21 is preferably in the form of a truncated pyramid having substantially parallel trapezoidal left and right side walls 25 and 27, respectively (the right side wall is shown in FIG. 3), an upwardly and inwardly sloping front wall 29 (FIG. 4), and an upwardly and inwardly sloping rear wall 31. The front and rear walls 29 and 31, as well as a bottom wall 33 and a top wall 35 (FIG. 6), are preferably substantially square or rectangular. The bottom wall 33 and the top wall 35 are preferably parallel to one another.

The shipping and display box 21 is preferably provided with large holes 37 in each of the left and right side walls 25 and 27, the front wall 29, and the rear wall 31 to facilitate ventilation and watering of the product (not shown), usually fresh asparagus. The shipping and display box 21 is preferably also provided with perforations for forming diverter tabs 39 on each of the front wall 29 and the rear wall 31 for diverting water into the box and for ventilation. The diverter tabs 39 are preferably formed by perforating inverted "U" shapes in the front wall 29 and the rear wall 31 and pushing or pulling the thus-formed substantially half-circle areas away from the walls so that the half-circle areas project away from the walls at an angle.

Figure 7:
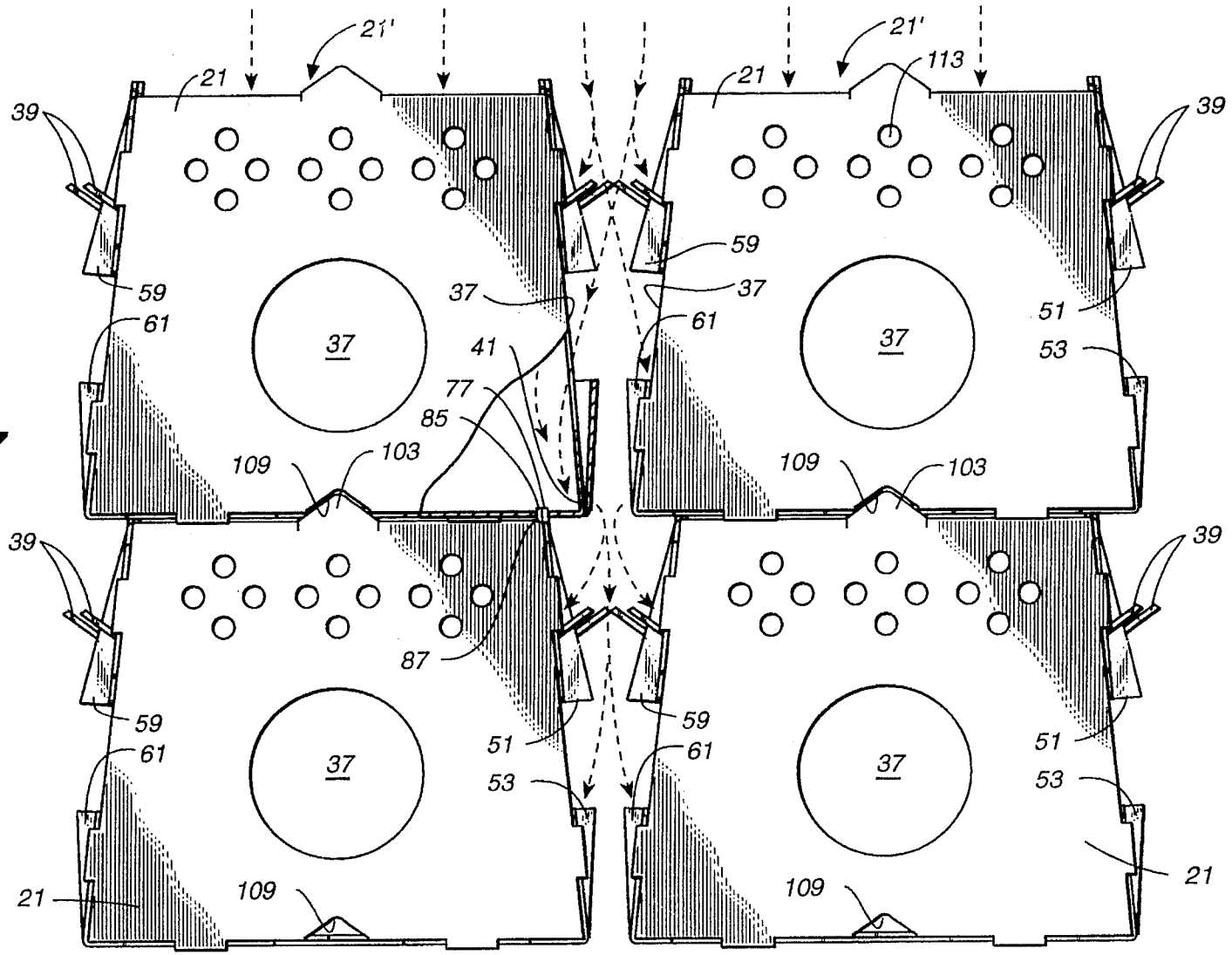
FIG. 7 is a side view of adjacent stacks of shipping and display boxes according to an embodiment of the present invention.

Upper portions 39' of the diverter tabs 39 are preferably removed to facilitate gripping of the diverter tabs and pulling them away from the front wall 29 and the rear wall 31. Removal of these upper portions 39' of the diverter tabs 39 also facilitates ventilation of the finished shipping and display box 21. Corner drain holes 41 and 41' are provided in the region of the bottom front and bottom rear corners 43, 45 of the shipping and display box 21, directly vertically below each of the diverter tabs 39 to permit water to flow out of the corner drain holes of an upper box and into a lower box upon being diverted into the lower box by the diverter tabs of the lower box, as seen in FIG. 7. Outer corner drain holes 41 preferably extend around the bottom front and bottom rear corners 43 and 45, while central ones of the corner drain holes 41' are disposed substantially only in the front and rear walls 29 and 31, and do not extend past the bottom front or bottom rear corners.

Figure 4:
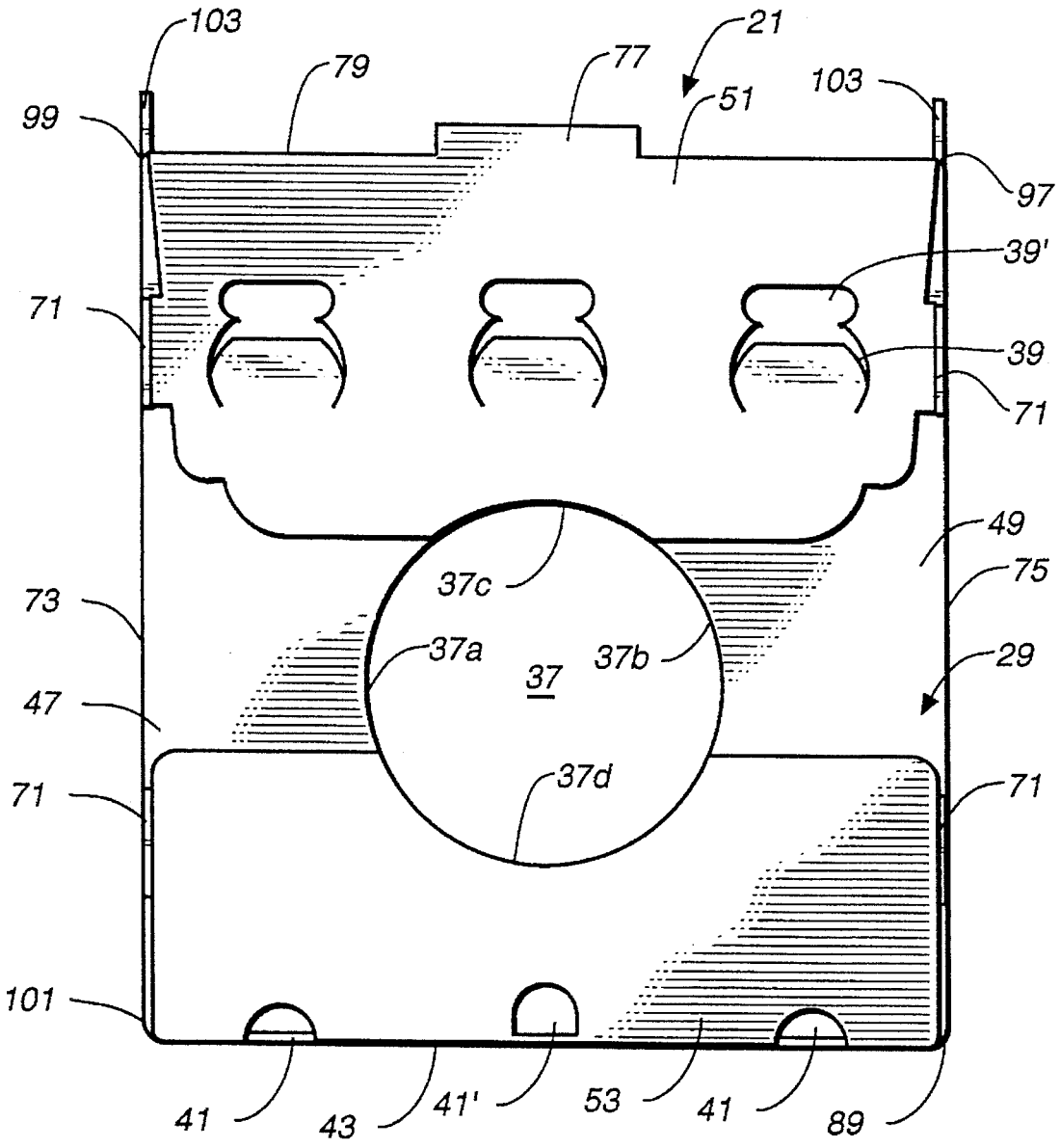
FIG. 4 is a view of a front wall of a shipping and display box according to an embodiment of the present invention.
Figure 5:
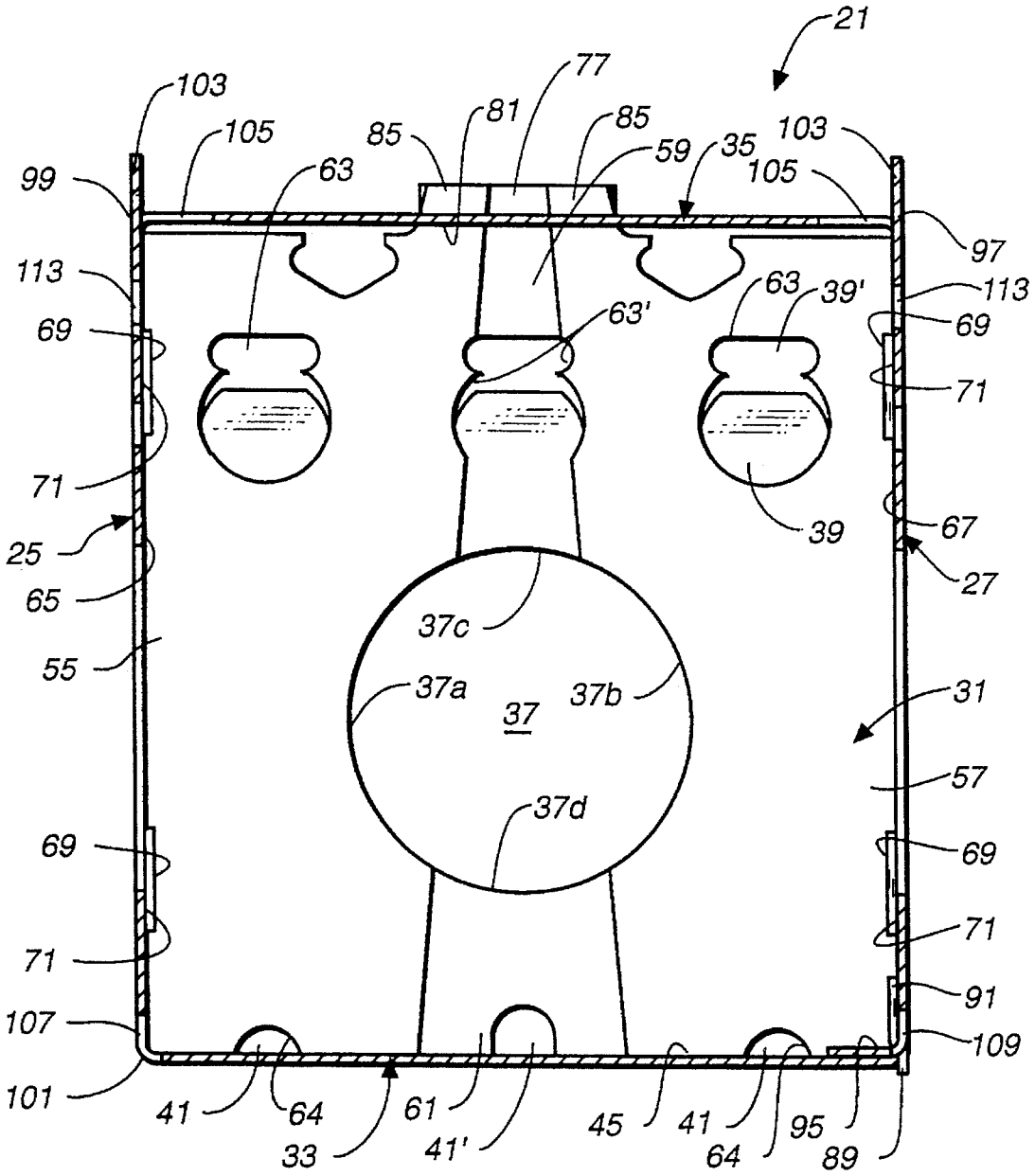
FIG. 5 is a cross-sectional side view of the shipping and display box of FIG. 1, taken at section 5—5 of FIG. 1.

As seen in FIGS. 1 and 4, the front wall 29 includes a left panel 47, a right panel 49, a top panel 51, and a bottom panel 53. As seen in FIG. 5, the rear wall 31 similarly includes a left panel 55, a right panel 57, a top panel 59, and a bottom panel 61. The left and right panels 47 and 49 of the front wall 29 and the left and right panels 55 and 57 of the rear wall 31 are folded underneath the top and bottom panels 51 and 53 of the front wall and the top and bottom panels 59 and 61 of the rear wall, respectively. As seen in FIGS. 1 and 4, the diverter tabs 39 are provided in the top panel 51 of the front wall 29. Diverter tabs 39 are similarly provided in the top panel 59 of the rear wall 31.

As seen in FIG. 5, the left panel 55 of the rear wall is provided with a hole 63 disposed adjacent to the diverter tab 39 nearest the rear left side corner 65 of the shipping and display box 21. Recesses 63' are provided along edges of the left and right panels 55 and 57 of the rear wall 31 adjacent to a center diverter tab 39 on the top panel 59. The right panel 57 of the rear wall 31 is provided with a hole 63 disposed adjacent to the diverter tab 39 nearest the rear right side corner 67 of the shipping and display box 21. The holes 63 and recesses 63' permit water diverted into holes formed by the diverter tabs 39 to enter the interior of the shipping and display box 21. Similar holes 63 and recesses 63' are provided in the left and right panels 47 and 49 of the front wall 29.

The left and right panels 47 and 49 of the front wall 29 and the left and right panels 55 and 57 of the rear wall 31 are provided with recesses 64 at bottom edges of the panels. The recesses 64 align with the outer corner drain holes 41 to facilitate the flow of water out of the outer corner drain holes.

Figure 2:
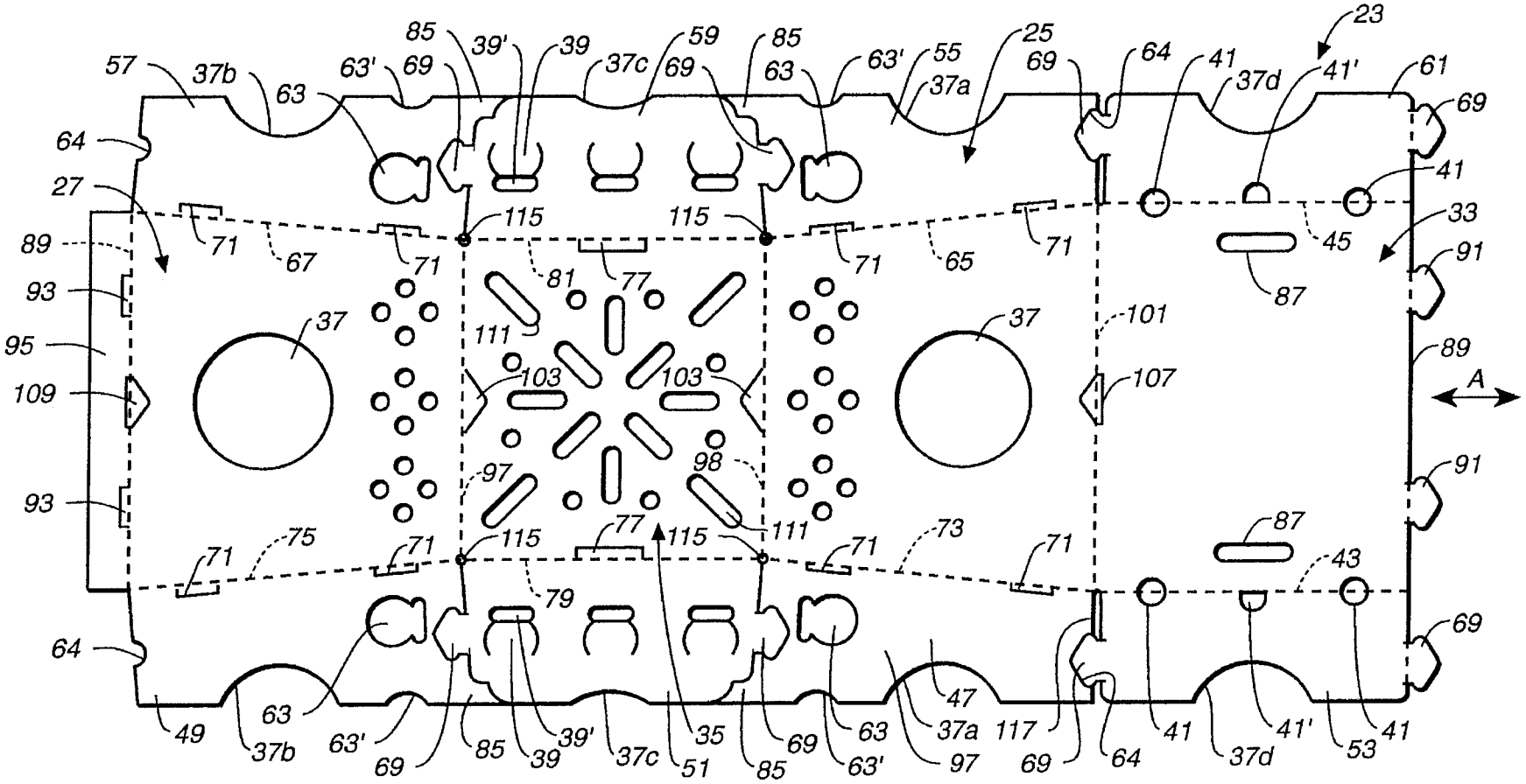
FIG. 2 is a top plan view of a blank for forming a shipping and display box according to an embodiment of the present invention.

The top and bottom panels 51 and 53 of the front wall 29 and the top and bottom panels 59 and 61 of the bottom wall 31 are each provided with arrow-shaped tabs 69, seen on the blank 23 shown in FIG. 2, on right and left sides of the top and the bottom panels. The tabs 69 are also seen inside of the shipping and display box 21 in FIG. 5. The tabs 69 on the top and bottom panels 51 and 53 of the front wall 29 are received in slots 71 provided at the front left side corner 73 and at the front right side corner 75 of the shipping and display box 21. The tabs 69 on the top and bottom panels 59 and 61 of the rear wall 31 are received in slots 71 provided at the rear left side corner 65 and at the rear right side corner 67 of the shipping and display box 21. As noted above, the tabs 69 are preferably arrow-shaped. The "arrow-head" portions of the tabs 69 are preferably sufficiently wider than the slots 71 such that, upon being forced into the slots, the tabs are only removed with difficulty, thereby ensuring that the shipping and display box 21 remains in an assembled condition.

The holes 37 provided in the front wall 29 and the rear wall 31 are formed upon formation of the front wall. The left panels 47 and 55 of the front wall 29 and the rear wall 31, respectively, are each provided with a recess **37*a* at right edges. The right panels 49 and 57 of the front wall 29 and the rear wall 31, respectively, are each provided with a recess 37*b* at left edges. The top panels 51 and 59 of the front wall 29 and the rear wall 31, respectively, are each provided with a recess 37*c* at bottom edges. The bottom panels 53 and 61 of the front wall 29 and the rear wall 31, respectively, are each formed with a recess 37*d* at top edges. When the panels forming the front and rear walls 29 and 31 are locked in place, the recesses 37*a*, 37*b*, 37*c*, and 37*d* define the hole 37**.

As seen in FIGS. 1 and 3–7, stacking tabs 77 protrude upwardly from the top front corner 79 and the top rear corner 81 of the shipping and display box 21. The stacking tabs 77 are preferably formed upon folding the top panels 51 and 59 of the front and rear walls 29 and 31, respectively, relative to the top wall 35 when forming the shipping and display box 21 by providing the blank 23 for forming the shipping and display box with substantially U-shaped slots at points corresponding to the top front corner 79 and the top rear corner 81. Upon folding the top panels 51 and 59 relative to the top wall 35, the stacking tabs 77 protrude upwardly and also form openings 83 on the top wall adjacent the stacking tabs. Tabs 85 provided on upper edges of the left and right panels 47 and 49 of the front wall 29 and the left and right panels 55 and 57 of the rear wall extend through the openings 83 to secure the left and right panels of the front and rear walls relative to the top wall 35 and to strengthen the stacking tabs 77.

Stacking holes 87 are provided in the bottom wall 33 proximate the bottom front corner 43 and the bottom rear corner 45. The stacking holes 87 are disposed substantially vertically below the stacking tabs 77 and the tabs 85 on the left and right panels of the front and rear walls such that, as seen in FIG. 7, the stacking holes of a shipping and display box 21 stacked on top of another box receive the stacking tabs of the lower box, thereby aligning the two boxes relative to one another and preventing relative movement of the two boxes. The alignment of stacked shipping and display boxes 21 provided by the stacking tabs 77 and the stacking holes 87 watering of lower boxes with water flowing through the corner drain holes 41 and 41' of upper boxes into the lower boxes through the holes formed by the diverter tabs 39 that are vertically aligned with the corner drain holes. The central corner drain holes 41' preferably do not extend past the front and rear bottom corners 43 and 45 in order to provide additional strength to the portion of the shipping and display box 21 between the central corner drain holes and the stacking holes 87.

Figure 6:
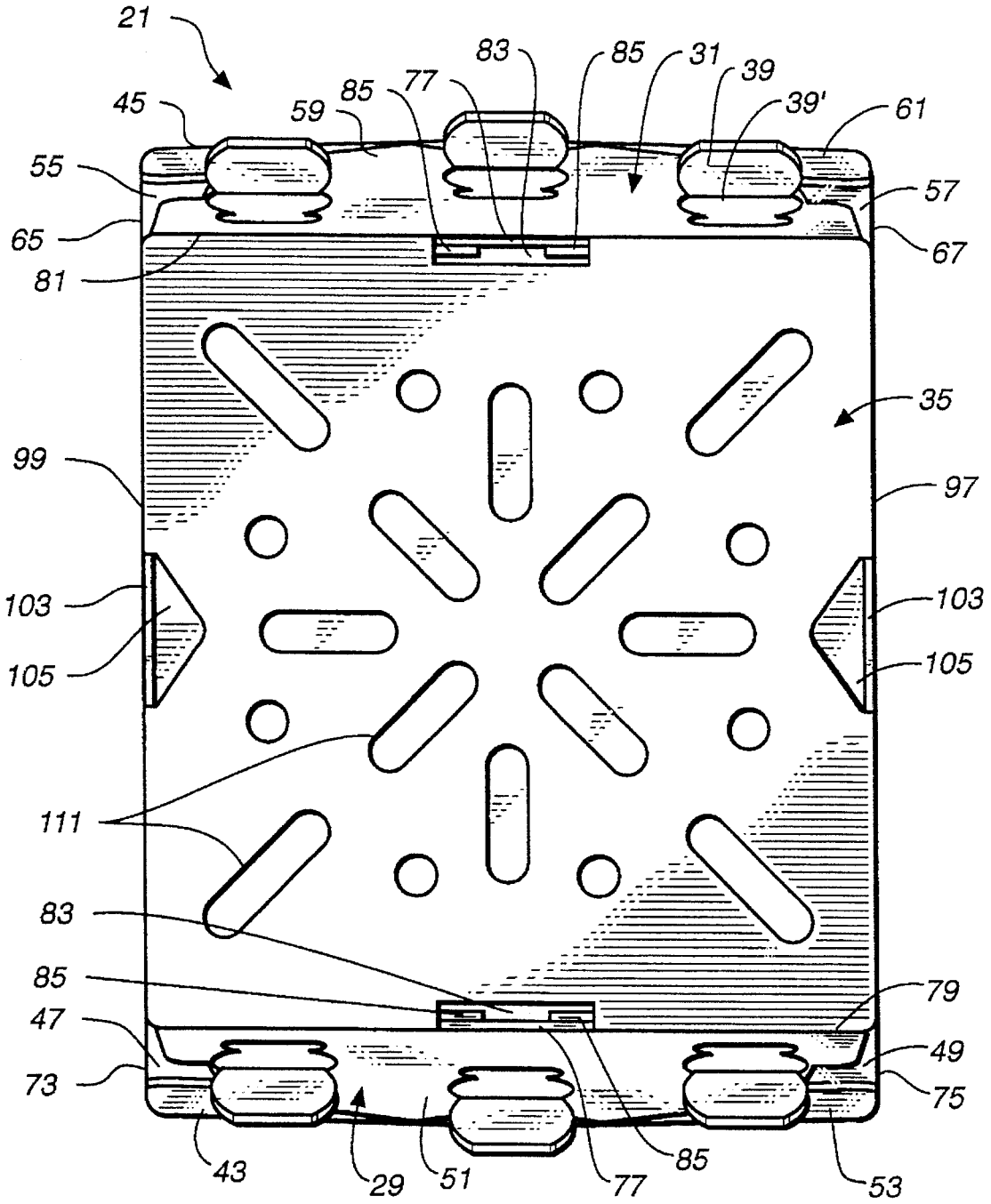
FIG. 6 is a top view of a shipping and display box according to an embodiment of the present invention.

As seen with reference to FIGS. 3, 6, and 7, the top and bottom panels 51 and 53 of the front wall 29 and the top and bottom panels 59 and 61 of the rear wall 31 preferably bow outwardly. As seen in FIG. 7, the outward bowing of the top and bottom panels facilitates water flow off of top panels of the shipping and display boxes 21 of one stack 21' of boxes into the holes 37 provided in the front or rear walls 29 or 31 of boxes in adjacent stacks, the outwardly bowed bottom panels facilitating capture of such water flow. The outward bowing of the top and bottom panels is preferably provided by virtue of the "memory" of the top and bottom panels, which would tend to unfold relative to the top and bottom walls 33 and 35 but are restrained at the left and right edges of the top and bottom panels by the tabs 69 and slots 71. Center portions of the top and bottom panels, which are not fastened down, tend to push outward as the top and bottom panels try to unfold, causing the top and bottom panels to bow outward at their centers, relative to the constrained left and right edges. The arrow-shaped tabs 69 include a short "shaft" portion between the "arrow-head" portion of the tabs and the left and right edges of the top and bottom panels to provide a greater overall width to the top and bottom panels, thereby further facilitating the outward bowing of those panels.

As seen in FIGS. 1 and 5, a bottom edge of the right side wall 29 is attached to a right edge of the bottom wall 33 at the bottom right side corner 89 of the shipping and display box 21 by arrow-shaped tabs 91 provided on the right edge of the bottom wall that are received in slots 93 provided in a flap 95 on the bottom edge of the right side wall. The flap 95 is folded around the bottom right side corner adjacent an inner side of the bottom wall 33, and the tabs 91 are folded around the bottom right side corner adjacent an inner side of the right side wall 29. The width of a head portion of the tabs 91 is preferably greater than the width of the slots 93 to inhibit unintended withdrawal of the tabs.

The top right side corner 97 is preferably formed by folding the right side wall 29 relative to the top wall 35. The top left side corner 99 is preferably formed by folding the left side wall 27 relative to the top wall. The bottom left side corner 101 is preferably formed by folding the left side wall relative to the bottom wall 33.

Upwardly extending side stacking or registration tabs 103 are preferably provided at the top left side corner 99 and the top right side corner 97. The side registration tabs 103 are preferably formed by providing V-shaped slots on the top wall 35 with an open side of the "V" adjacent the top left side corner 99 and the top right side corner 97. Upon folding the left side wall 27 and the right side wall 29 relative to the top wall 35, the registration tabs 103 extend upwardly and a V-shaped opening 105 is formed adjacent the tabs.

A left side registration hole 107 and a right side registration hole 109 are formed vertically below the registration tabs 103 in the left and right side walls 27 and 29, respectively, extending upwardly from the bottom left side corner 101 and the bottom right side corner 89, respectively. Registration tabs 103 of a lower box are received in the registration holes 107 of an upper box stacked on top of the lower box. The registration holes 107 and registration tabs 103 facilitate proper alignment and prevent movement of stacked boxes in a similar fashion to that described above with regard to the stacking tabs 77 and the stacking holes 89. Further, the visible registration holes 107 and registration tabs 103 facilitate properly orienting two shipping and display boxes 21 for insertion of the stacking tabs 77 of a lower box into the stacking holes 89 of an upper box, the stacking tabs 77 and the stacking holes 89 both normally being concealed by the upper box.

Ventilation and watering holes 111 are preferably provided on the top wall 35. The ventilation and watering holes 111 facilitate ventilation and watering of top boxes in stacks 21' of boxes. The ventilation and watering holes 111 of lower ones of the boxes 21 in the stack 21' are generally covered by upper boxes. Side ventilation holes 113 are preferably provided in the left and right side walls 27 and 29 to facilitate ventilation of boxes. When stacks 21' of boxes 21 are arranged adjacent to one another on pallets, the side ventilation holes 113 of boxes in adjacent stacks are adjacent or nearly adjacent to one another, thereby facilitating air flow. Also, apertures 39' and 39 facilitate air flow through the box.

As seen in FIG. 7, when shipping and display boxes 21 are arranged in stacks 21' and upper ones of the shipping and display boxes are watered, water enters the upper one of the boxes through the holes 37 in the front and rear walls as water cascades off of the outwardly bowing top panels of the front and rear walls of boxes in adjacent stacks, through the ventilation and watering holes 111, and through the holes formed by the diverter tabs 39. The water flows out of the boxes through the corner drain holes 41 and 41'. The boxes are preferably filled with water up to the bottoms of the holes 37, at which point the water flows out of the boxes through those holes, as well as through the corner drain holes.

The water cascades out of the upper boxes onto the top panels of the front and rear walls 29 and 31 of lower boxes. The water on the top panels is diverted into the lower boxes by the diverter tabs 39 or cascades off of the bottom edges of the top panels. Some of the water that cascades off of the bottom edges of the top panels enters boxes in adjacent stacks through the holes 37 in the front or rear walls of those boxes.

As noted above, each shipping and display box 21 is preferably in the form of a truncated pyramid in which the front and rear walls 29 and 31 slope inwardly and upwardly. As seen in FIG. 7, when stacks 21' of boxes 21 are positioned relative to one another so that the front or rear walls 29 or 31 of the shipping and display boxes of one stack are adjacent the front or rear walls of the shipping and display boxes of another stack, a substantially triangular or wedge-shaped space is formed between the shipping and display boxes of the two stacks.

The wedge-shaped space permits the diverter tabs 39 to extend outwardly from the front and rear walls 29 and 31 without interference from other surfaces, such as diverter tabs on other boxes. Further, the space formed between adjacent stacks 21' of shipping and display boxes facilitates air flow through and around the boxes to keep the produce packed in the boxes fresh. Features such as the diverter tabs 39, the corner drain holes 41, and the inwardly and upwardly sloping front and rear walls 29 and 31 of the shipping and display box 21 facilitate the watering of multiple stacks of boxes by simply watering an uppermost level of the stacks of boxes and allowing the water to flow down through to lowermost ones of the boxes.

The holes provided by the diverter tabs 39 and the ventilation holes 111 and 113 are all smaller in diameter than the large holes 37. By providing the smaller holes 39, 111, and 113 in a top portion of the shipping and display box 21, a venturi effect is created when the refrigerated, cooler air in the box absorbs heat from the product inside the box, rises to the top of the box, and then passes out of the smaller holes at the upper part of the box. When this warmer air moves out through these smaller holes, the air increases in velocity. This is shown by the mass flow rate equation:

$$Q=pVA$$

where Q is the mass flow rate, p is the mass density, V is the velocity, and A is the cross-sectional area of the orifice.

As the area of an orifice through which a particular volume of air passes in a given time decreases, the velocity of the air increases. Accordingly, as the velocity of the air flow increases through the smaller cross-sectional holes 39, 111, and 113, the venturi effect is understood to result in more air being pulled into the box through the larger, less restricted, ventilation holes 37. This can be represented by the continuity equation:

$$Q=(VA)1=(VA)2$$

where (VA)1 is the velocity of air flow multiplied by the area of the larger hole, and (VA)2 is the velocity of air flow multiplied by the area of the smaller hole. The foregoing assumes that mass density of air is substantially constant, which is a reasonable assumption as velocity and pressure changes of air during normal use hydro-cooling of the contents of the shipping and display box are understood to be minimal.

As seen in FIG. 2, the shipping and display box 21 described above is preferably formed from a single piece blank 23. For purposes of reference, FIG. 2 is considered to show an inner side of the blank 23 which would be disposed on an inside of the shipping and display box 21, although it will be understood that the blank could be considered to be illustrating an outer side of the blank. As noted above, the box forming material is preferably a corrugated plastic material. The C-flutes of the material are preferably arranged in the direction of the arrow A to provide maximum compressive strength to the shipping and display box 21.

The blank 23 is preferably arranged such that the right side wall 27 is hinged to, i.e., folded at, the top wall 35 at the top right side corner 97, the top wall is hinged to the left side wall 25 at the top left side corner 99, and the left side wall is hinged to the bottom wall 33 at the bottom left side corner 101. The flap 95 is hinged to the right side wall 27 at the bottom right side corner 89 on a left side of the blank 23 and the flaps 91 are hinged to the bottom wall 33 at the bottom right side corner 89 on a right side of the blank.

The left panels 47 and 55 of the front and rear walls 29 and 31, respectively, are hinged to the left side wall 25 at the front left side corner 73 and the rear left side corner 65, respectively. The right panels 49 and 57 of the front and rear walls 29 and 31, respectively, are hinged to the right side wall 27 at the front right side corner 75 and the rear right side corner 67, respectively. The top panels 51 and 59 of the front and rear walls 29 and 31, respectively, are hinged to the top wall 35 at the top front corner 79 and the top rear corner 81, respectively. The bottom panels 53 and 61 of the front and rear walls 29 and 31, respectively, are hinged to the bottom wall 33 at the bottom front corner 43 and the bottom rear corner 45, respectively.

The arrangement of the panels of the front and rear walls 29 and 31 relative to the left and right side walls 25 and 27, the top wall 35, and the bottom wall 33 facilitates forming the shipping and display box 21 such that at least portions of all of the vertical walls include vertical flutes of the corrugated material for forming the box. The vertical flutes provide great strength to the box 21 in compression. For example, when the flutes run in the direction A, the flutes run from top to bottom on the left and right side walls 25 and 27. The flutes also run from top to bottom on the left and right panels 47 and 49 of the front wall 29 and on the left and right panels 55 and 57 of the rear wall 31.

The blank 23 is preferably formed such that the tabs 69 at the left edges of the bottom panels 53 and 61 of the front and rear walls 29 and 31, respectively, are cut from material at bottom edges of the left panels 47 and 55 of the front and rear walls. In this manner, the cuts or perforations of the material at the bottom edges of the left panels 47 and 55 to form the tabs 69 define the recesses 64 that allow flow through the corner drain holes 41 at the bottom front corner 43 and the bottom rear corner 45 nearest the left side wall 27.

The shipping and display box 21 may be assembled from the blank 23 as follows. The tabs 91 are inserted into the slots 93 so that the tabs and the flap 95 are both disposed on the inner side of the substantially rectangular tube formed by inserting the tabs into the slots. The left and right panels 47 and 49 of the front wall 29 are folded relative to the front left and right side corners 73 and 75, respectively, and the tabs 85 on the upper edges of the left and right panels are inserted into the opening 83 at the top front corner 79 formed by the stacking tab 77. Likewise, the left and right panels 55 and 57 of the rear wall 31 are folded relative to the rear left and right side corners 65 and 67, respectively, and the tabs 85 on the upper edges of the left and right panels are inserted into the opening 83 at the top rear corner 81 formed by the stacking tab 77.

The tabs 69 at the left and right edges of the bottom panel 53 of the front wall 29 are inserted into lower ones of the slots 71 on the front left and right side corners 73 and 75, respectively. The tabs 69 at the left and right edges of the bottom panel 61 of the rear wall 31 are inserted into lower ones of the slots 71 on the rear left and right side corners 65 and 67, respectively. The tabs 69 at the left and right edges of the top panel 51 of the front wall 29 are inserted into upper ones of the slots 71 on the front left and right side corners 73 and 75, respectively. The tabs 69 at the left and right edges of the top panel 59 of the rear wall 31 are inserted into upper ones of the slots on the rear left and right side corners 65 and 67, respectively. The diverter tabs 39 are pulled or pushed away from the top panels 51 and 59 of the front and rear walls 29 and 31.

To facilitate folding of the left panels 47 and 55 and the right panels 49 and 57 relative to the top panels 51 and 59, relief holes 115, seen in FIG. 2, are preferably provided at the corners defined by those panels. The relief holes 115 distribute stresses during folding and thus permit the panels to be folded without crushing or tearing of the box forming material at the corners. Relief slots 117 are preferably provided at the corners defined by the bottom panels 53 and 61 and the left panels 47 and 55 to facilitate folding of those panels.

Upon forming the shipping and display box 2 1 in the manner described above, the stacking tabs 77 and the registration tabs 103 project upwardly in the desired manner. The holes 63 and recesses 63' align with the openings defined by the opened diverter tabs 39 and the removed upper portions 39' of the diverter tabs. Further, the recesses 64 align with the corner drain holes 41. The blank 23 for forming the shipping and display box 21 thus offers an easily assembled, highly sturdy structure.

When the shipping and display box is used to transport fresh products, it is typical to provide an absorbent pad (not shown) inside the bottom of the shipping and display box to hold water so that the fresh product will be in contact with the water in the pad. As noted above, fresh products in multiple stacks of shipping and display boxes 21 may be simultaneously watered or "hydro-cooled" to maintain freshness of the products by watering a top level of the multiple boxes and allowing the water to flow down to lower boxes through the various drain holes, diverter tabs, etc.

The foregoing has described the principles, preferred embodiments and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of the present invention as defined by the following claims.

What is claimed is:

1. A stackable shipping and display box, comprising:

a substantially rectangular top wall having front, rear, left, and right edges;

two or more registration tabs, at least one of the registration tabs extending upwardly from each of the left and right edges of the top wall;

a substantially rectangular bottom wall having front, rear, left, and right edges;

trapezoidal left and right side walls, the left and right side walls being provided with registration holes corresponding in number to the registration tabs, the registration holes extending upwardly from bottom edges of the left and right side walls, having internal dimensions corresponding to external dimensions of the registration tabs, and being disposed vertically below the registration tabs; and a substantially rectangular front side wall, the front side wall being formed by four, single-thickness panels, a first one of the panels being folded down from the front edge of the top wall, a second one of the panels being folded up from the front edge of the bottom wall, and third and fourth ones of the panels being folded in from front edges of the left and right side panels; and a substantially rectangular rear side wall, the rear side wall being formed by four, single-thickness panels, a first one of the panels being folded down from the rear edge of the top wall, a second one of the panels being folded up from the rear edge of the bottom wall, and third and fourth ones of the panels being folded in from rear edges of the left and right side panels, wherein the first and second panels forming the front and rear side walls, individually, extend less than half of a height of the front and rear side walls and the third and fourth panels forming the front and rear side walls, individually, extend less than half of a width of the front and rear side walls, compressive forces on the stackable box being borne by the left and right side walls and by the third and fourth ones of the panels forming the front and rear side walls to prevent compression of contents of the stackable box.

2. The stackable shipping and display box as set forth in claim 1, wherein the left and right side walls are hinged to the top wall at the left and right edges, respectively, the registration tabs being formed upon folding the left and right side walls relative to the top wall.

3. A stackable shipping and display box, comprising:

a substantially rectangular top wall having front, rear, left, and right edges;

a substantially rectangular bottom wall having front, rear, left, and right edges;

trapezoidal left and right side walls; and two or more stacking tabs, at least one of the stacking tabs extending upwardly from each of the front and the rear edges of the top wall, the bottom wall being provided with stacking holes proximate the front and rear edges, the stacking holes corresponding in number to the stacking tabs, having internal dimensions corresponding to external dimensions of the stacking tabs, and being disposed vertically below the stacking tabs.

4. The stackable shipping and display box as set forth in claim 3, wherein the left and right edges of the bottom wall are longer than the left and right edges of the top wall and the stacking holes are provided at equal distances from the front and rear edges of the bottom wall.

5. The stackable shipping and display box as set forth in claim 3, further comprising a front wall portion and a rear wall portion hinged to the top wall at the front and rear edges, respectively, the stacking tabs being formed upon folding the front and rear wall portions relative to the top wall.

6. The stackable shipping and display box as set forth in claim 3, further comprising two or more registration tabs, at least one of the registration tabs extending upwardly from each of the left and right edges of the top wall, the left and right side walls being provided with registration holes corresponding in number to the registration tabs, the registration holes extending upwardly from bottom edges thereof, having internal dimensions corresponding to external dimensions of the registration tabs, and being disposed vertically below the registration tabs.

7. A shipping and display box, comprising:

a top wall having left, right, front, and rear edges;

a left side wall at the left edge of the top wall;

a right side wall at the right edge of the top wall;

a sloped side wall between the left and right side walls, the sloped side wall including a top panel hinged to one of the front and the rear edges of the top wall, the sloped side wall sloping substantially upwardly and inwardly, an opening being formed in the sloped side wall below at least a portion of the top panel;

means for securing left and right edges of the top panel to the left and right side walls, respectively, such that a central portion of a bottom edge of the top panel bows outwardly relative to the one of the front and rear edges of the top wall, wherein, when the box is placed adjacent a substantially identical second box such that the sloped side wall of the box faces the sloped side wall of the second box, water flowing off of the outwardly bowed central portions of the top panels of the box and the second box flows into the openings in the sloped side walls of the second box and the box, respectively.

8. The shipping and display box as set forth in claim 7, further comprising a bottom wall having left, right, front, and rear edges, the sloped side wall including a bottom panel hinged to one of the front and rear edges of the bottom wall, the opening being formed in the sloped side wall above at least a portion of the bottom panel, the box further comprising means for securing left and right edges of the bottom panel to the left and right side walls, respectively, such that a central portion of a top edge of the bottom panel bows outwardly relative to the one of the front and rear edges of the bottom wall, wherein, when the box and the second box are positioned beside each other, the outwardly bowed central portion of the bottom panel projects outwardly into a path of water flowing off of the outwardly bowed central portion of the top panel of the second box.

9. The box as set forth in claim 7, wherein, when the box and the second box are positioned beside each other, the sloped side walls of the box and the second box define a wedge-shaped space between the adjacent box and second box.

10. The box as set forth in claim 9, wherein the wedge-shaped space facilitates ventilating the box.

11. The box as set forth in claim 7, wherein the top panel includes means for diverting water flowing down the top panel into one or more second holes provided in the top panel.

12. The box as set forth in claim 11, wherein the diverting means includes one or more tabs extending outwardly from the top panel.

13. The box as set forth in claim 7, wherein multiple ones of the box are stackable on top of one another.

14. A stackable shipping and display box, comprising:

a bottom wall;

a left side wall folded from the bottom wall to define a bottom left side edge;

a top wall folded from the left side wall to define a top left side edge;

a right side wall folded from the top wall to define a top right side edge;

a front wall including a single thickness left side panel folded from the left side wall to define a front left side edge, and a single thickness right side panel folded from the right side wall to define a front right side edge;

a rear wall including a single thickness left side panel folded from the left side wall to define a rear left side edge, and a single thickness right side panel folded from the right side wall to define a rear right side edge, wherein the left and right side panels of the front wall and the rear wall extend, individually, less than half of a width of the front Wall and the rear wall, and compressive forces on the box are borne by the left side wall, the right side wall, and the left and right side panels of the front wall and the rear wall to prevent compression of contents of the box.

15. A stackable shipping and display box, comprising:

a bottom wall:

a left side wall folded from the bottom wall to define a bottom left side edge;

a top wall folded from the left side wall to define a top left side edge;

a right side wall folded from the top wall to define a top right side edge:

a front wall including a left side panel folded from the left side wall to define a front left side edge, and a right side panel folded from the right side wall to define a front right side edge;

a rear wall including a left side panel folded from the left side wall to define a rear left side edge, and a right side panel folded from the right side wall to define a rear right side edge, wherein the box is formed from a single piece of corrugated material having longitudinal flutes that extend substantially vertically in the left side wall, the right side wall, the left side and right side panels of the front wall, and the left side and right side panels of the rear wall.

16. The stackable shipping and display box as set forth in claim 15, wherein the corrugated material is corrugated plastic.

17. The stackable shipping and display box as set forth in claim 15, further comprising means for securing top edges of the left side and right side panels of the front wall and top edges of the left side and right side panels of the rear wall at top front and top rear edges of the box.

18. The stackable shipping and display box as set forth in claim 17, wherein the securing means includes tabs provided at the top edges of the left side and right side panels of the front wall and at the top edges of the left side and right side panels of the rear wall, and tab receiving slots at top front and top rear edges of the box.

19. The stackable shipping and display box as set forth in claim 15, wherein the front wall and the rear wall each further include a top panel folded from the top wall to define the top front edge and the top rear edge, respectively, and a bottom panel folded from the bottom wall to define a bottom front edge and a bottom rear edge, respectively.

20. The stackable shipping and display box as set forth in claim 17, wherein the top panel, the bottom panel, the left panel, and the right panel of the front and rear walls define central openings in the front and rear walls.

21. The stackable shipping and display box as set forth in claim 19, wherein the left side panel and the top panel of the front and rear walls define a top left front corner and a top left rear corner, respectively, and the right side panel and the top panel of the front and rear walls define a top right front corner and a top right rear corner, respectively, relief holes being provided at the top left front corner, the top left rear corner, the top right front corner, and the top right rear corner to facilitate folding of the panels.

22. The stackable shipping and display box as set forth in claim 15, wherein the front wall and the rear wall each further include a top panel folded from the top wall to define the top front edge and the top rear edge, respectively, and a bottom panel folded from the bottom wall to define a bottom front edge and a bottom rear edge, respectively.

23. The stackable shipping and display box as set forth in claim 22, wherein the top panel, the bottom panel, the left panel, and the right panel of the front and rear walls define central openings in the front and rear walls.

24. The stackable shipping and display box as set forth in claim 22, wherein the left side panel and the top panel of the front and rear walls define a top left front corner and a top left rear corner, respectively, and the right side panel and the top panel of the front and rear walls define a top right front corner and a top right rear corner, respectively, relief holes being provided at the top left front corner, the top left rear corner, the top right front corner, and the top right rear corner to facilitate folding of the panels.

25. A blank for forming a shipping and display box, comprising:

a right side wall portion defined by left, right, front, and rear edges;

a top wall portion defined by front, rear, left, and right edges, the left edge of the top wall portion being attached to the right edge of the right side wall portion;

a left side wall portion defined by left, right, front, and rear edges, the left edge of the left side wall portion being attached to the right edge of the top wall portion;

a bottom wall portion defined by front, rear, left, and right edges, the left edge of the bottom wall portion being attached to the right edge of the left side wall portion;

front side wall portions including right, top, left, and bottom panels attached at front edges of the right side wall portion, the top wall portion, the left side wall portion, and the bottom wall portion, respectively;

rear side wall portions including right, top, left, and bottom panels attached at rear edges of the right side wall portion, the top wall portion, the left side wall portion, and the bottom wall portion, respectively; and the blank being formed from corrugated material such that a longitudinal direction of flutes of the material extends from left to right.

26. A stackable shipping and display box, comprising:

a substantially rectangular top wall having front, rear, left, and right edges;

a substantially rectangular bottom wall having front, rear, left, and right edges;

trapezoidal left and right side walls;

two or more stacking tabs, at least one of the stacking tabs extending upwardly from each of the front and the rear edges of the top wall, the bottom wall being provided with stacking holes proximate the front and rear edges, the stacking holes corresponding in number to the stacking tabs, having internal dimensions corresponding to external dimensions of the stacking tabs, and being disposed vertically below the stacking tabs; and two or more registration tabs, at least one of the registration tabs extending upwardly from each of the left and right edges of the top wall, the left and right side walls being provided with registration holes corresponding in number to the registration tabs, the registration holes extending upwardly from bottom edges thereof, having internal dimensions corresponding to external dimensions of the registration tabs, and being disposed vertically below the registration tabs.

27. The stackable shipping and display box as set forth in claim 26, wherein the left and right edges of the bottom wall are longer than the left and right edges of the top wall and the stacking holes are provided at equal distances from the front and rear edges of the bottom wall.

28. The stackable shipping and display box as set forth in claim 26, further comprising a front wall portion and a rear wall portion hinged to the top wall at the front and rear edges, respectively, the stacking tabs being formed upon folding the front and rear wall portions relative to the top wall.

29. A stackable shipping and display box, comprising:

a bottom wall;

a left side wall folded from the bottom wall to define a bottom left side edge;

a top wall folded from the left side wall to define a top left side edge;

a right side wall folded from the top wall to define a top right side edge;

a front wall including a left side panel folded from the left side wall to define a front left side edge, and a right side panel folded from the right side wall to define a front right side edge;

a rear wall including a left side panel folded from the left side wall to define a rear left side edge, and a right side panel folded from the right side wall to define a rear right side edge, tabs provided at top edges of the left side and right side panels of the front wall and at top edges of the left side and right side panels of the rear wall, and tab receiving slots at the top front and top rear edges of the box for receiving the tabs and securing the top edges of the left side and right side panels of the front wall and top edges of the left side and right side panels of the rear wall at top front and top rear edges of the box, so that the tabs define registration tabs extending upwardly above the top wall; and openings provided in the bottom wall vertically below the registration tabs, the openings having internal dimensions corresponding to external dimensions of the registration tabs, wherein the box is formed from a single piece of corrugated material having longitudinal flutes that extend substantially vertically in the left side wall, the right side wall, the left side and right side panels of the front wall, and the left side and right side panels of the rear wall.

30. The stackable shipping and display box as set forth in claim 29, wherein the left and right side panels of the front wall and the rear wall extend, individually, less than half of a width of the front wall and the rear wall, and compressive forces on the box are borne by the left side wall, the right side wall, and the left and right side panels of the front wall and the rear wall to prevent compression of contents of the box.

31. The stackable shipping and display box as set forth in claim 29, wherein the corrugated material is corrugated plastic.

32. A blank for forming a shipping and display box, comprising:

a trapezoidal right side wall portion defined by left, right, front, and rear edges, the right edge of the right side wall portion being smaller than the left edge of the right side wall portion;

a top wall portion defined by front, rear, left, and right edges, the left edge of the top wall portion being attached to the right edge of the right side wall portion;

a trapezoidal left side wall portion defined by left, right, front, and rear edges, the left edge of the left side wall portion being attached to the right edge of the top wall portion and being smaller than the right edge of the left side wall portion;

a bottom wall portion defined by front, rear, left, and right edges, the left edge of the bottom wall portion being attached to the right edge of the left side wall portion;

front side wall portions including right, top, left, and bottom panels attached at front edges of the right side wall portion, the top wall portion, the left side wall portion, and the bottom wall portion, respectively;

rear side wall portions including right, top, left, and bottom panels attached at rear edges of the right side wall portion, the top wall portion, the left side wall portion, and the bottom wall portion, respectively;

the blank being formed from corrugated material such that a longitudinal direction of flutes of the material extends from left to right;

front registration tab portions disposed at right and left edges of the right and left panels, respectively, of the front side wall portions;

rear registration tab portions disposed at right and left edges of the right and left panels of the rear side wall portions;

registration tab receiving openings provided in the bottom wall portion and spaced inwardly from front and rear edges of the bottom wall portion.

* * * * *